US005520296A

United States Patent [19]

Freed

[11] Patent Number: 5,520,296

[45] Date of Patent: May 28, 1996

[54] VIRTUAL HINGE

[76] Inventor: Anna B. Freed, 185 E. 85th St., New York, N.Y. 10028

[21] Appl. No.: 324,892

[22] Filed: Oct. 18, 1994

Related U.S. Application Data

[63] Continuation-in-part of Ser. No. 16,148, Dec. 9, 1993, abandoned, which is a continuation-in-part of Ser. No. 850,029, Mar. 12, 1992, Pat. No. 5,297,687.

[51] Int. Cl.[6] ..... B65D 55/02

[52] U.S. Cl. ..... 215/206; 215/213; 215/223; 215/237; 116/308; 116/324

[58] Field of Search ..... 215/206, 211, 215/213, 223, 230, 235, 237; 206/534; 116/308, 321, 323, 324

[56] References Cited

U.S. PATENT DOCUMENTS

| | | | |
|---|---|---|---|
| 3,587,896 | 6/1971 | Graff . | |
| 3,627,160 | 12/1971 | Horvath . | |
| 3,656,645 | 4/1972 | Fontenelli . | |
| 3,765,578 | 10/1973 | Stull . | |
| 3,766,882 | 10/1973 | Babbitt, III . | |
| 3,871,662 | 3/1975 | Hepp . | |
| 3,896,958 | 7/1975 | Robbins et al. . | |
| 3,996,879 | 12/1976 | Walter . | |
| 4,043,475 | 8/1977 | Wheeler . | |
| 4,053,077 | 10/1977 | De Felice . | |
| 4,053,078 | 10/1977 | Herr . | |
| 4,121,727 | 10/1978 | Robbins et al. . | |
| 4,238,033 | 12/1980 | Artzt . | |
| 4,365,721 | 12/1982 | Montgomery . | |
| 4,375,859 | 3/1983 | Fillmore . | |
| 4,397,397 | 8/1983 | Herr . | |
| 4,405,045 | 9/1983 | Villa-Real . | |
| 4,424,910 | 1/1984 | Heinol . | |
| 4,429,800 | 2/1984 | Greenspan . | |
| 4,485,932 | 12/1984 | Kusz . | |
| 4,573,598 | 3/1986 | Perry . | |
| 4,573,599 | 3/1986 | Fillmore . | |
| 4,579,238 | 4/1986 | Herr . | |
| 4,666,051 | 5/1987 | Trick . | |
| 4,739,890 | 4/1988 | Cooke . | |
| 4,749,093 | 6/1988 | Trick . | |
| 4,753,189 | 6/1988 | Mastman et al. . | |
| 4,913,083 | 4/1990 | Valvo et al. . | |
| 5,011,032 | 4/1991 | Rollman . | |
| 5,040,691 | 8/1991 | Hayes et al. . | |
| 5,065,876 | 11/1991 | Joyce | 215/206 |
| 5,082,129 | 1/1992 | Kramer . | |
| 5,083,671 | 1/1992 | Hayes . | |
| 5,292,017 | 3/1994 | Reifers | 215/206 |
| 5,312,010 | 5/1994 | Johnson . | |

FOREIGN PATENT DOCUMENTS

| | | |
|---|---|---|
| 7437858 | 1/1992 | France . |

*Primary Examiner*—Allan N. Shoap
*Assistant Examiner*—Stephen Cronin
*Attorney, Agent, or Firm*—Darby & Darby

[57] ABSTRACT

A dynamic virtual hinge closure used for controlled, reliable, and measured dispensing of a variety of substances with extensive monitoring, child-resistance and senior friendly features. A hook dynamically engages with a slot to create a virtual hinge each time the closure is opened. The hook dynamically disengages with the slot each time the closure is closed. Monitoring is accomplished by markers positioned on one part of the external cylindrical front surface of the container or lid. The monitoring may be for dispensing of food such as spices (e.g., pour, shake, spoon); or for dispensing of drugs (e.g., 1st, 2nd, 3rd dose) or simply to determine whether the closure is in a locked or unlocked position. The closure is easily moldable, simple to assemble,, sealed on the top and side, and configured to accept a moisture vapor seal and/or tamper indicating film.

20 Claims, 4 Drawing Sheets

SHAKE
310
312
314
318
320
322
324
326
328
330
331
332
334
336
338
340
342

VIRTUAL HINGE

This application is a Continuation-In-Part of application Ser. No. 29/016,148 filed Dec. 9, 1993, now abandoned, which is a Continuation-In-Part of application Ser. No. 07/850,029, filed on Mar. 12, 1992, now U.S. Pat. No. 5,297,687 granted Mar. 29, 1994, the disclosure of which is hereby incorporated by reference.

BACKGROUND OF THE INVENTION

Field of the Invention

The present invention relates to container closures, in particular, to a dynamically created one piece virtual hinge closure which provides enhanced utility for dispensers and containers.

The present invention may be utilized in closures for food, spices, cleaning products, toxic substances, drugs, lens covers, gas caps, film canisters and containers for candies, nuts, bolts, screws and notions etc. This closure may attach directly to a container or may be attached to the top of an existing dispenser as an overcap. The dynamic virtual hinge closure provides a synergistic effect when used as an overcap with dispensers such as pull-push, pumps, tilt-top, roll-on, sponge-tip, snap-type, sprays etc. Accordingly, virtual hinge closures have extremely widespread utility.

One important use is for both prescription and over-the-counter products. Although a child-resistant compliance closure is especially required by both the younger and older population segments, everyone would benefit from an improved closure which is captive, is easy to use, simple to understand, durable, reliable, reusable, and additionally is easily and inexpensively manufactured and assembled.

The virtual hinge closure can be configured about most existing dispensers such as nasal sprays or eye drops, to provide for monitored dispensing of a pre-measured dose with child-resistance and/or "senior friendly" features (facilitating opening by the elderly).

The present invention has an external hinge, minimal or no undercuts or cams, and a one piece child-resistance mechanism. These features all contribute to simplify the tooling and molding of the closure.

The present invention advantageously utilizes the familiar, already tested, "Align Arrows and Push Up with Thumb", for child-resistance. The virtual hinge closure could be configured to be "senior friendly" (requiring less strength to open by providing additional leverage). Additional leverage could be provided by attaching a tall cylindtical member to the top of the lid.

Prior art closures require the pharmacist to stock and attach different caps and/or containers for different dispensing frequencies. The present invention advantageously may utilize both the same lid and container for different dispensing frequencies eliminating the need to dispense and maintain inventory of different lids and containers.

Unlike these prior an closures, the dynamic virtual hinge closure of the present invention advantageously enables conversion to a child-resistant compliance closure for preconfigured over-the-counter dispensers and prescription containers, thus providing for the monitored dispensing of different substance forms such as solids, liquids, powders and sprays.

SUMMARY OF THE INVENTION

The present invention provides a novel concept for dispensing systems by providing a dynamic virtual hinge lid for existing dispensers. The lid may be configured with or without monitoring features. Monitored dispensing may be on an "as desired" basis as with spices (shake, spoon, pour etc.) or sequential (1,2,3 etc.) as with medicaments.

In the first two embodiments, FIGS. 1–4C and 5–8C, the lid may be opened after the user has rotated it into alignment (i.e., the pointer on the container is aligned with a marker on the lid). This one piece, captive closure has minimal undercuts and may be easily molded by injection molding. The container is flat on top so that a moisture vapor seal and/or tamper proof film can be readily inserted therein. Additionally, the container and lid contact each other on two contiguous surfaces (top and side). The closures of FIGS. 5–8C and 13–16C contain a bead surrounding the entire closure. Since the bead surrounds the entire closure, the lids may be readily snapped down onto the container in any orientation thus simplifying the assembly.

The lid is locked to the container on two diametrically opposite sides, by a hook hugging a bead on one side and a locking lug in a locking groove on the other side. The cross-section of the bead adjacent to the slot in FIGS. 5–8C, 13–16C may be modified to eliminate the undercuts which would otherwise be required when forming the slots, and thus substantially simplifies the tooling and molding.

In the second two embodiments FIGS. 9–12C and 13–16C, the pointer and marker(s) are reversed. Namely, the pointer is on the lid and the marker(s) are on the container. These two embodiments have many of the same features as the first two embodiments such as:

1) It is a one piece, captive closure with monitoring capability;
2) Both the container and lid can be easily and inexpensively molded;
3) The lid need not be oriented to be assembled (FIGS. 13–16C);
4) The ability to include a moisture vapor seal and/or tamper proof film; and
5) Contact on two contiguous surfaces (bottom and side) of the lid and container.

Of course, the lid may not require the child-resistance or monitoring features, e.g., as with a gas cap, camera lens, or food closures. The lid could simply alternate between a closed and opened position and need not rotate around the entire circumference of the container as shown in FIGS. 1–4C and 9–12C.

Accordingly, it is an object of the present invention to provide a useful and versatile lid which is reliable (there are no moving parts), inexpensive (only one part) and easy to manufacture (by injection mold and/or injection blow mold) remains captive when opened, and is easy to assemble (no need to orient the pans). The present invention has only one required pan besides the container, "the lid". The present invention requires fewer pans than any other known closures with these extensive features.

A further object of the present invention is to provide a simple closure that is independent of the dispenser. This virtual hinge feature may transform a dispenser to a closure with monitoring and/or child-resistance features.

The present invention is opened by rotating the lid until the pointer is aligned with a marker and then pushing up on the lid with the thumb. This child-resistance feature is in common use and is further described in U.S. Pat. No. 4,121,727 to Robbins et al. and U.S. Pat. No. 3,627,160 to Horvath. Neither of these closures however, possess the extensive features of the present invention.

An object of the present invention is to provide a simple (one piece), reliable (no moving parts), and captive closure which aids user compliance. By using this invention, a user can readily monitor his/her own medication regimen, thus reducing medication errors, and also decreasing the involvement of health care professionals by providing a means for self medication for users who might otherwise need assistance due to reduced mental and/or visual acuity or impaired physical strength or dexterity.

A further object and novel concept of the present invention is to provide a single lid structure and design for different dispensing frequencies. This novel structure and design is comprised of a "front" which displays all the markers, thus enabling the user to monitor "at a glance" his/her next dose. The user may also vary frequency by obscuring the unwanted marker(s) with tape. Thus, the same lid may be used for different dose frequencies. The numbers may be represented by raised vertical lines or protrusions which are easier to mold than numerals.

An alternative method of providing a single structure for the different frequencies for 2, 3 or 4 doses/day is for the lid (or container) to have 12 markers. A label with appropriate dose numbers repeated could then be attached thereon for 2, 3 or 4 times per day.

A further object is to provide a closure with extensive utility. The virtual hinge closure may be used for pet food, fertilizer, spices, cosmetics, gas caps, camera lens covers, nuts and bolts, candies, beads etc. The dynamic virtual hinge closure may also serve as a receptacle, rather than a dispenser, such as food storage or waste disposal containers.

A still further object and novel concept of this invention is to integrate ergonomic design with the user's own kinesthetic senses to facilitate dispensing by creating a routine that is automatic and foolproof. With this ergonomic design a user is relieved from the necessity of reading often difficult to read instructions on the label each time he/she needs to make dispensing decisions.

This is accomplished by the intermittent clicks prior to opening (to prevent skipping a dose) and after closing (to insure the lid is locked), the position of the pointer relative to the marker(s), and direction arrow(s) on top surface. In combination, these features, by integrating the senses of touch (recessed markers, raised pointer), motion (stopping), sound (clicking), and sight (pointer and markers on the "front") result in a habitual dispensing routine by maximizing the users own kinesthetic senses. Additionally, there are advantageously no verbal indicia required, facilitating use by users who speak different languages, are illiterate, or blind.

Another object of the present invention is to provide a single closure containing features required by both over-the-counter and prescription items while simplifying the tooling and molding of this closure. For example, for mass production of over-the-counter substances 1) the closure may be assembled by forcing the lid onto the container straight down under pressure (i.e., the hook would flex over the bead due to its resiliency).
2) The container and lid meet such that a moisture resistant weld and tamper proof film can be readily placed therein.
3) The lid and container touch on two contiguous surfaces, top and side, to enhance moisture vapor retention.

A further object is to simplify tooling and facilitate molding by configuring the virtual hinge to have minimal or no undercuts or camming actions.

BRIEF DESCRIPTION OF DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENTS

Four non-limiting exemplary embodiments of the virtual hinge according to the present invention are illustrated in FIGS. 1–16C. The first two embodiments represented by FIGS. 1–4 and 5–8, respectively, have a hook on the container and a slot(s) in the lid. The second two embodiments, represented by FIGS. 9–12 and 13–16, respectively, are reversed, having the hook on the lid and the slot(s) in the container. The embodiments shown in FIGS. 1–4 and 9–12 have only one marker (or opening position) while the embodiments shown in FIGS. 5–8 and 13–16 have more than one marker corresponding to different opening positions.

Figure 1:
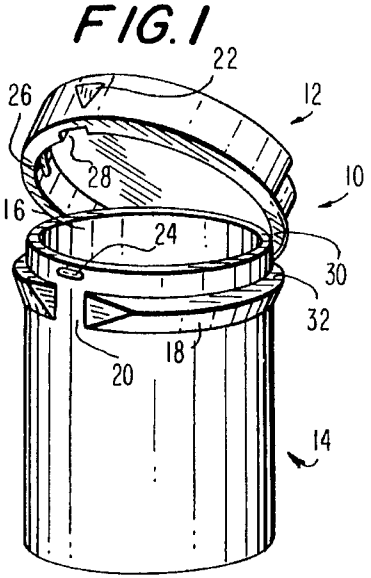
FIG. 1 shows a perspective view of the virtual hinge having a hook on the container and one marker on the lid.

As shown in FIG. 1, a preferred embodiment of a virtual hinge in accordance with the present invention is designated generally by the reference character 10. The virtual hinge 10 includes a cylindrical lid 12 and a cylindrical container 14. The container includes a top port 16. The lid 12 is shown unlocked and in the open position in FIG. 1.

Figure 3:
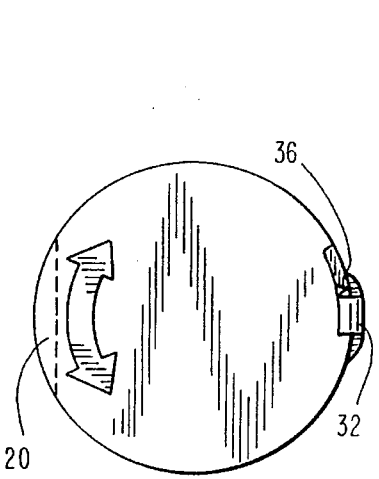
FIG. 3 shows a top view of the unlocked lid of FIG. 2C.
Figure 2B:
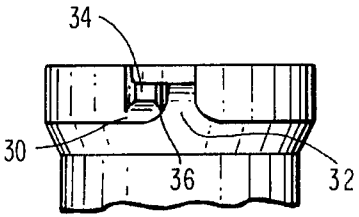
FIG. 2B shows a rear view of the locked lid of FIG. 2A.
Figure 2A:
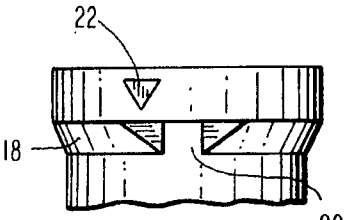
FIG. 2A shows a front view of the virtual hinge lid of FIG. 1 in a locked position.
Figure 2D:
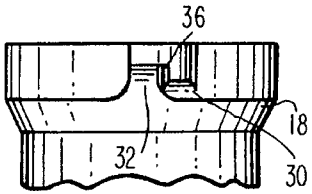
FIG. 2D shows the rear view of the unlocked lid of FIG. 2C.
Figure 2C:
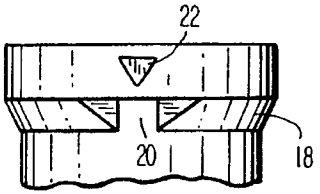
FIG. 2C shows the front view of the virtual hinge lid of FIG. 1 in the unlocked position.
Figure 4C:
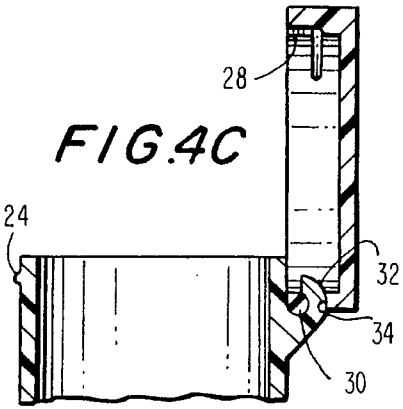
FIG. 4C shows a cross-section of the unlocked lid of FIG. 4B after it has been opened.
Figure 4A:
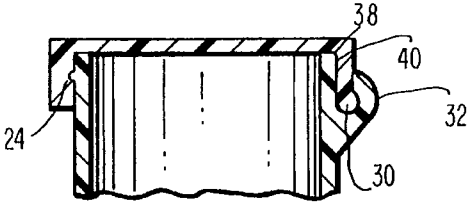
FIG. 4A shows a cross-section of the locked lid of FIG. 2A.
Figure 4B:
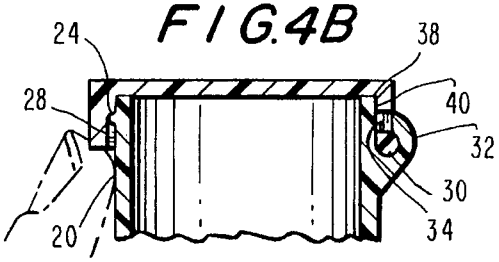
FIG. 4B shows a cross-section of the unlocked lid of FIG. 2C as it is about to be opened with a user's thumb.
Figure 7:
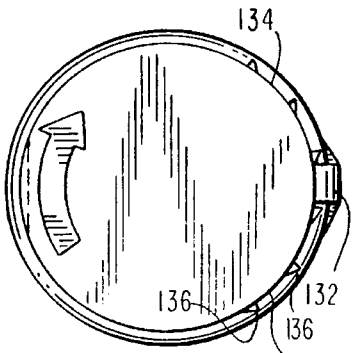
FIG. 7 shows a top view of the unlocked lid of FIG. 6C.
Figure 8C:
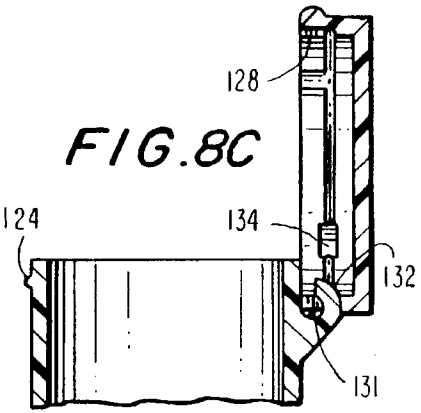
FIG. 8C shows a cross-section of the unlocked lid of FIG. 8B after it has been opened.
Figure 6B:
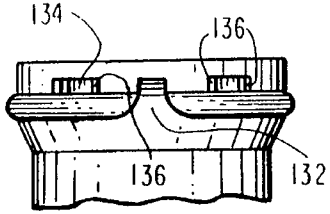
FIG. 6B shows a rear view of the locked lid of FIG. 6A.
Figure 6D:
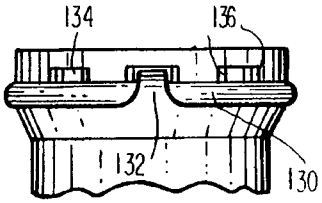
FIG. 6D shows the rear view of the unlocked lid of FIG. 6C.
Figure 8A:
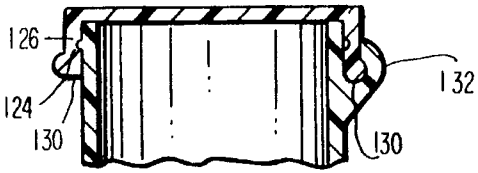
FIG. 8A shows a cross-section of the locked lid of FIG. 6A.
Figure 6A:
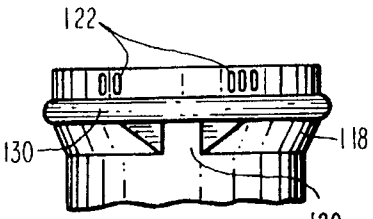
FIG. 6A shows a front view of the virtual hinge lid of FIG. 5 in a locked position.
Figure 6C:
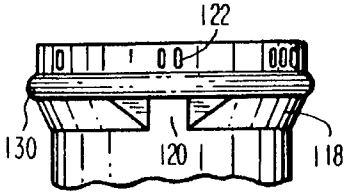
FIG. 6C shows the front view of the virtual hinge lid of FIG. 5 in the unlocked position.
Figure 5:
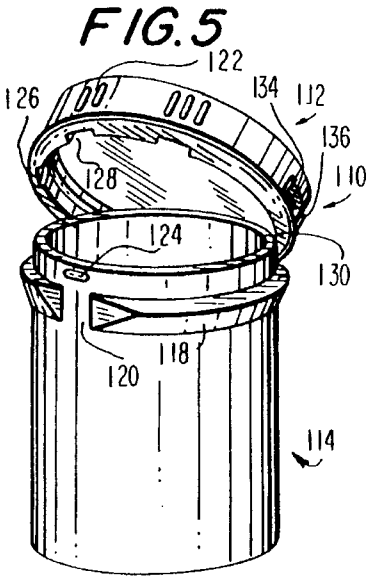
FIG. 5 shows a perspective view of the virtual hinge having a hook on the container and more than one marker on the lid.
Figure 8B:
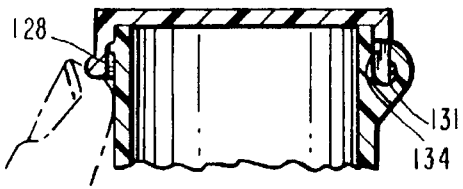
FIG. 8B shows a cross-section of the unlocked lid of FIG. 6C as it is about to be opened with a user's thumb.
Figure 11:
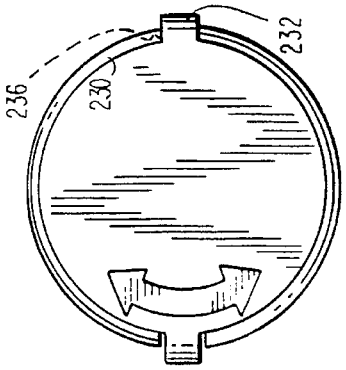
FIG. 11 shows a top view of the unlocked lid of FIG. 10C.
Figure 10B:
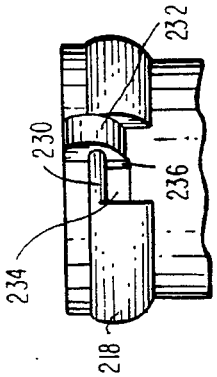
FIG. 10B shows a rear view of the locked lid of FIG. 10A.
Figure 10D:
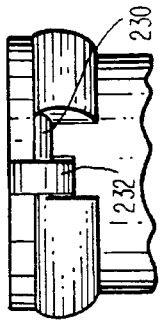
FIG. 10D shows the rear view of the unlocked lid of FIG. 10C.
Figure 10A:
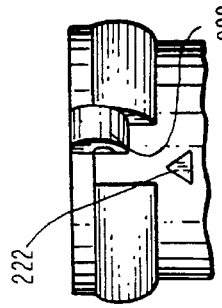
FIG. 10A shows a front view of the virtual hinge lid of FIG. 9 locked.
Figure 10C:
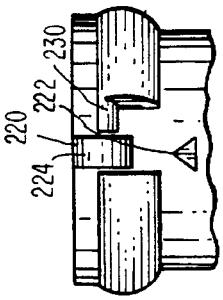
FIG. 10C shows the front view of the virtual hinge lid of FIG. 9 in the unlocked position.
Figure 12C:
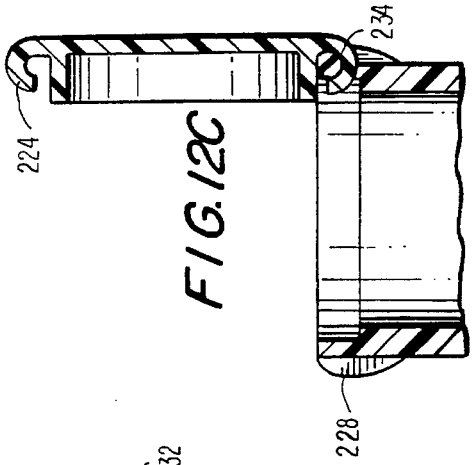
FIG. 12C shows a cross-section of the unlocked lid of FIG. 12B after it has been opened.
Figure 12A:
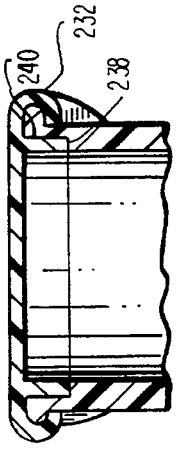
FIG. 12A shows a cross-section of the locked lid of FIG. 10A.
Figure 9:
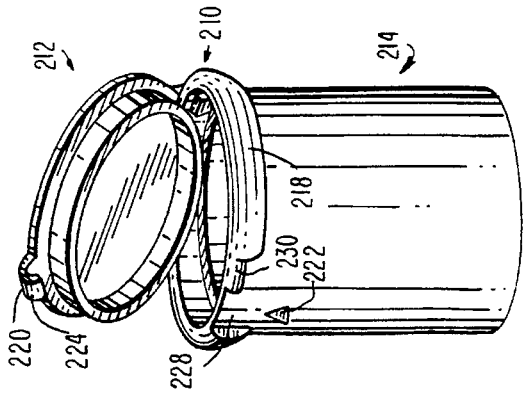
FIG. 9 shows a perspective view of the virtual hinge having a hook and a locking member on the lid and one marker on the container.
Figure 12B:
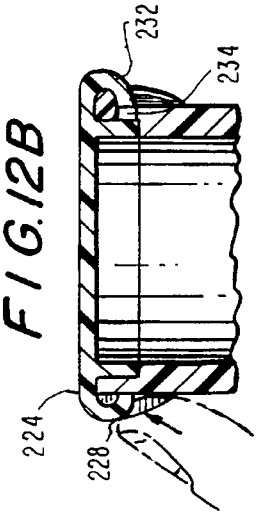
FIG. 12B shows a cross-section of the unlocked lid of FIG. 10C as it is about to be opened with a user's thumb.
Figures 13, 14A, 14B, 14C, 14D, 15, 16A, 16B, 16C:
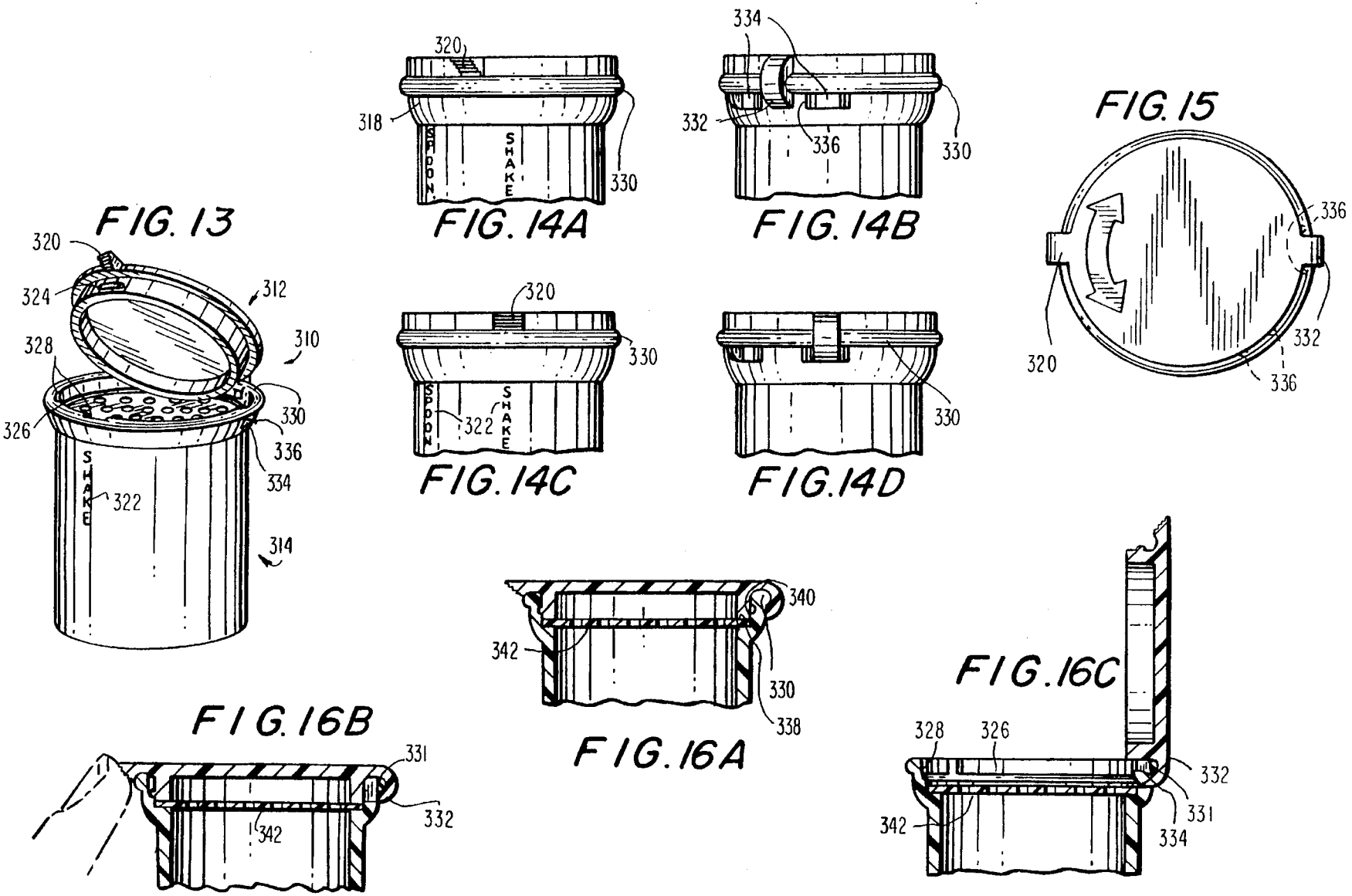
FIG. 13 shows a perspective view of the virtual hinge having a hook on the lid and more than one marker on the container.
FIG. 14A shows a front view of the virtual hinge lid of FIG. 13 locked.
FIG. 14B shows a rear view of the locked lid of FIG. 14A.
FIG. 14C shows the front view of the virtual hinge lid of FIG. 13 in the unlocked position.
FIG. 14D shows the mar view of the unlocked lid of FIG. 14C.
FIG. 15 shows a top view of the unlocked lid of FIG. 14C.
FIG. 16A shows a cross-section of the locked lid of FIG. 14A.
FIG. 16B shows a cross-section of the unlocked lid of FIG. 14C as it is about to be opened with a user's thumb.
FIG. 16C shows a cross-section of the unlocked lid of FIG. 16B after it has been opened.

In the open position, the lid 12 is spaced from the port 16. An annular rib 18 on the container 14, contains a gap 20 within it. This gap 20, provides a space where the user can insert his/her thumb to push the lid up, and also acts as a pointer which when aligned with the marker 22, indicates that the lid is in the unlocked position. A locking lug 24 on the outside cylindrical surface of the container 14 is rotatably held by a locking groove 26 disposed on the inside cylindrical surface of the lid when the container is closed. The locking lug 24 is released from the locking groove 26 when the container is opened. To open the container, the user first rotates the lid until the marker 22 and pointer 20 are aligned. The user then lifts the lid causing the locking lug to move through the locking groove release 28. As the user lifts the lid, a hook 32 on tile container dynamically engages with a slot 34 in the lid. The hook 32 is diametrically opposite the locking lug 24. The hook 32 aligns with the slot 34 when the user aligns the pointer 20 with the marker 22. This causes the locking lug 24 to be positioned in the locking groove release 28. A protrusion 36 is positioned next to the slot 34 and provides a sensory signal to the user that the hook 32 has been rotated into or out of the locked position. The closure is locked in FIGS. 2A–B and 4A and the closure is unlocked in FIGS. 1, 2C–D, 3 and 4B–C. This embodiment of the virtual hinge alternates back and forth between the locked and unlocked position as the lid is in the closed position and is rotated with respect to container 14. FIG. 3 shows a top view of the protrusion 36 and the hook 32. The hook 32 must snap past this protrusion 36 as it is rotated from a locked to an unlocked position. In FIG. 4C the lid is fully opened and the hook 32 is engaged in the slot 34 and surrounds the bead 30. The bead 30 and the locking groove 26 partially extend circumferentially around the outside and inside of the cylindrical surface of the lid respectively, and are disposed diametrically opposite each other. When the closure is closed as illustrated in FIGS. 4A–B, the top 38 and side 40 of the container are in continuous contact with the inside of the lid thus forming a seal on two contiguous surfaces. This enhances moisture vapor retention and permits insertion of a tamper proof film.

In the embodiment illustrated, in FIGS. 5–8C, there are three markers 122 with indicia I, II, and lII disposed on the outer cylindrical surface of lid 112. The markers are shown flush with the outer cylindrical surface of the lid 112. Of course, the markers could also be raised or recessed. The markers are shown on what is referred to as a front portion of the outer cylindrical surface of the lid 112. In the preferred embodiment, the markers are positioned on a portion of the outer cylindrical surface that is less than 180 degrees so that the user can easily see or feel all the markers without rotating the container. A bead 130 surrounds the entire lid 112 allowing the lid to rotate about the entire circumference of tile container. The hook 132 holds down the bead on the lid as it rotates from marker to marker. The lid is additionally held down by the locking lug 124 held in locking groove 126. Three slots 134 are disposed in lid 112 diametrically opposite tile three markers 122.

Protrusions 136 are disposed on either side of each slot. These protrusions signal to the user that the lid has been locked or unlocked and also permit the lid to rotate in one direction only (due to their triangular shape). The hook 132, must snap past these protrusions 136 as the lid is rotated from a locked to an unlocked position. Three locking groove releases 128 are disposed on the interior cylindrical surface of the lid 112, directly behind tile three markers 122, and also diametrically opposite the three slots 134. To open the lid, the user lifts up the lid by pushing his/her thumb up into a gap (or pointer 120) in the annular rib 118. The lid will only open when the lid is in the unlocked position, (i.e., when one of the markers 122 is aligned with the pointer 120 and the hook 132 is positioned behind one of the slots 134 as shown in FIGS. 6C–D, 7, 8B–C). Upward movement on the lid causes the locking lug 124 to move through the locking groove release 128 and the hook 132 to dynamically engage with the slot 134. In this embodiment, a portion of the bead 130 below the slot 134, has a modified cross-section 131 (i.e., eliminating the projecting portion) to simplify molding and tooling.

The embodiment shown in FIGS. 9–12C shows the hook 232 disposed on the lid 212 and the slot 234 disposed in the container 214. A marker 222 on the container 214 aligns with a pointer 220 on the lid to signal to the user that the lid is in the unlocked position as illustrated in FIGS. 10C–D, 11 and 12B–C. Locking member 224 surrounds bead 230 and also acts as a pointer. A gap 228 disposed in the bead 230 forms the locking groove release and permits the locking member 224 to move up while the hook 232 dynamically moves into the slot 234. After the lid is replaced to its closed position, it is rotated, causing the hook 232 to snap past a protrusion 236, the locking member 224 to be held down by the bead 230 and the lid is again locked. The lid and container form a seal on two contiguous surfaces, the bottom of the lid 238 and the side 240.

The embodiment shown is FIGS. 13–16C includes two markers 322 disposed on the outer cylindrical surface of the container 314, which, for example, may state SHAKE and SPOON. The bead 330 surrounds the entire container and thus the lid 312 does not need to be oriented when placed onto the container 314 during assembly. The protrusions 336 cause the hook to snap into and out of the locked position and are shaped to allow the lid 312 to be turned in either direction. Of course, protrusions could also (or alternatively) be placed within the locking groove 326, before and after the locking groove releases 328 to serve the same purpose. This embodiment also includes a plate containing holes 342. When the lid 312 is in the SPOON position, plate 342 lifts up with the lid by engagement with the locking lug 324 and the hook 332. The plate 342 remains down when the pointer indicates SHAKE, thus allowing the contents to be shook from the container through the holes in plate 342. As discussed in the previous embodiment, a portion of the bead 330 adjacent the slot 334 may have a modified cross-section to simplify molding and tooling.

The closure has been described as being in an open and closed position and as being in an unlocked and locked position. The closure is in the open position when the lid is spaced from the container and the hook is engaged with a slot. The closure is in the unlocked position when the pointer is aligned with a marker and the hook is positioned to enter the slot. The closure is in the locked position when the pointer and marker are out of alignment, and the lid is held down on opposite sides.

1) The lid is held down on one side by a hook surrounding the bead.

2) the lid is held down on the opposite side by the locking lug held in the locking groove or a locking member surrounding the bead.

Although this invention has been described generally and in terms of a presently preferred exemplary embodiments, these should not be construed as limiting the scope of the invention. For example, the hook might have a different shape and still perform the same function of holding the lid to the container in a fixed position relative to the pointer. The marker(s) and/or pointer may have different shapes, be flat (rather than raised or recessed), and/or have no numerical indicia (i.e., lines or pictures etc.) for reduced production costs. There could be markers for each day of the week, which could be equally spaced rather than on "the front".

The protrusions next to the slots may be modified or may be eliminated. Protrusions may be in the locking groove on either side of the locking groove release(s). The bead may surround the entire closure as shown in FIGS. 5–8C and 13–16C or on a portion of the closure as shown in FIGS. 1–4C and 9–12C. The bead may have an elliptical cross-section rather than circular. The locking groove may be disposed in the bead, etc. Thus, the scope of this invention should be determined by the appended claims and their legal equivalents, rather than the examples given. While the invention has been described in connection with what is presently considered to be the most practical and preferred embodiments, it is to be understood that the invention is not limited to the disclosed embodiments, but on the contrary, is intended to cover various modifications and equivalent arrangements included within the spirit and scope of the appended claims.

What is claimed is:

1. A virtually hinged closure, comprising:

(a) a substantially cylindrical lid;

(b) a substantially cylindrical container, said lid being movable between a closed and an opened position, said closed position including a locked position and a released position, wherein in said locked position said lid is immovable to said opened position and in said released position said lid is movable to said opened position, said lid rotatably fixed relative to said container in said open position only;

(c) at least one marker position being associated with one of said lid and said container;

(d) pointer means for indicating said at least one marker position, said pointer means being associated with the other one of said lid and said container;

(e) locking means for rotatably locking said lid to said container in said closed position, said locking means being disposed on an outer surface of said lid and said container;

(f) selective release means for allowing selective release of said locking means; and, (g) dynamic selective engagement means which dynamically cooperates with said selective release means for selectively engaging said lid to said container during movement of said lid from said closed to said opened position, said dynamic selective engagement means selectively fixing one of said at least one marker position with respect to said pointer means.

2. A virtually hinged closure according to claim 1 wherein said locking means includes a hook on one of said lid and said container and a bead on the other one of said lid and said container, said hook engages with said bead to rotatably lock said lid to said container in said closed position.

3. A virtually hinged closure according to claim 2 wherein said dynamic selective engagement means includes said hook and said bead, said hook selectively engaging with a slot disposed adjacent to said bead and pivoting about said bead during movement of said lid from said closed to said opened position.

4. A virtually hinged closure according to claim 1 wherein said locking means includes a locking lug on one of said lid and said container, said locking lug rotates within a locking groove on the other one of said lid and said container.

5. A virtually hinged closure according to claim 4 wherein said selective release means includes a locking groove release, enabling release of said locking lug from said locking groove when said lid is moved from said closed to said opened position.

6. A virtually hinged closure according to claim 1 further including an indicating means for indicating to the user when the lid has been rotated from said locked position to said released position.

7. A virtually hinged closure according to claim 1 further including a means for permitting rotation of said lid with respect to said container in a first direction and for preventing rotation of said lid with respect to said container in a second opposite direction.

8. A virtually hinged closure according to claim 1 wherein said dynamic selective engagement means is located on the exterior of said virtual hinge closure.

9. A virtually hinged closure according to claim 1 wherein two contiguous surfaces of said lid are in contact with two contiguous surfaces of said container.

10. A virtually hinged closure according to claim 1, wherein said selective release means is located in a fixed angular relationship with respect to said at least one marker position.

11. A virtually hinged closure, comprising:

(a) a substantially cylindrical lid;

(b) a substantially cylindrical container, said lid being movable between a closed and an opened position, said closed position including a locked position and a released position, wherein in said locked position said lid is immovable to said opened position and in said released position said lid is movable to said opened position, wherein in said opened position only said lid is rotatably fixed relative to said container;

(c) a first locking means for rotatably locking said lid to said container in said closed position, said first locking means being disposed on an outer surface of said lid and said container;

(d) a second locking means cooperating with said first locking means to lock said lid to said container in said closed position;

(e) a first selective release means for allowing selective release of said first locking means from said closed to said opened position and dynamically engaging said lid to said container in said opened position; and (f) a second selective release means cooperating with said first selective release means for allowing selective release of said second locking means.

12. A virtually hinged closure according to claim 11 wherein said first locking means includes a hook on one of said lid and said container and a bead on the other one of said lid and said container, said hook engages with said bead to rotatably lock said lid to said container in said closed position.

13. A virtually hinged closure according to claim 12 wherein said first selective release means includes said hook and said bead, said hook dynamically engages with a slot disposed adjacent to said bead and pivoting about said bead during selective release of said first locking means from said closed to said opened position.

14. A virtually hinged closure according to claim 11 wherein said second locking means includes a locking lug disposed on one of said lid and said container, said locking lug rotates within a locking groove on the other one of said lid and said container.

15. A virtually hinged closure according to claim 14 wherein said second selective release means includes a locking groove release, enabling release of said locking lug from said locking groove when said lid is moved from said closed to said opened position.

16. A virtually hinged closure according to claim 11, wherein said second locking means includes a locking member on one of said lid and said container, said locking member engages with said bead on the other one of sid lid and said container.

17. A virtually hinged closure according to claim 11, further including an indicating means for indicating to the user that the lid had been rotated from said locked position to said released position.

18. A virtually hinged closure according to claim 11 further including a means for permitting rotation of said lid with respect to said container in a first direction and for preventing rotation of said lid with respect to said container in a second opposite direction.

19. A virtually hinged closure according to claim 11 wherein said lid includes two contiguous surfaces that are in contact with two contiguous surfaces of said container.

20. A virtually hinged closure according to claim 11 wherein said first locking means are disposed diametrically opposite said second locking means.

* * * * *